US011760558B2

(12) United States Patent
Jones

(10) Patent No.: US 11,760,558 B2
(45) Date of Patent: Sep. 19, 2023

(54) DISPENSER CARTON BLANK AND ASSEMBLY

(71) Applicant: Richard F. Jones, Rockford, IL (US)

(72) Inventor: Richard F. Jones, Rockford, IL (US)

(73) Assignee: Richard F. Jones, Rockford, IL (US)

( * ) Notice: Subject to any disclaimer, the term of this patent is extended or adjusted under 35 U.S.C. 154(b) by 367 days.

(21) Appl. No.: 17/175,934

(22) Filed: Feb. 15, 2021

(65) Prior Publication Data

US 2022/0258952 A1 Aug. 18, 2022

(51) Int. Cl.
*B65D 83/08* (2006.01)
*B65H 16/00* (2006.01)

(52) U.S. Cl.
CPC ..... *B65D 83/0882* (2013.01); *B65H 16/005* (2013.01)

(58) Field of Classification Search
CPC .... B65D 83/0882; B65D 7/14; B65H 16/005; B65H 35/002; B65H 2402/443; B65H 2402/41; B65H 2701/1944; B26D 1/345
USPC ..... 225/45, 46, 47, 48, 49, 50; 83/589, 649, 83/175, 456, 455
See application file for complete search history.

(56) References Cited

U.S. PATENT DOCUMENTS 2,717,074 A * 9/1955 Williamson ..... 229/145
3,088,640 A 5/1963 Kunsch
3,144,970 A * 8/1964 Beschmann ..... B65D 85/672 225/48
3,477,624 A 11/1969 Branyon et al.
3,531,032 A 9/1970 Miles, Jr.
3,777,957 A * 12/1973 Buttery ..... B65D 83/0882 225/50
3,933,288 A 1/1976 Struble
4,130,228 A 12/1978 Perrin
4,238,065 A * 12/1980 Ragsdale ..... B65D 85/672 225/48
4,399,935 A 8/1983 Nelder
4,458,570 A 7/1984 Morrison
4,582,234 A 4/1986 Marcoux
4,646,956 A 3/1987 Ruff et al.
4,715,519 A * 12/1987 Fischer ..... B65D 85/672 225/80
4,899,918 A 2/1990 Oketani et al.
5,078,311 A 1/1992 Taguchi et al.
5,135,784 A 8/1992 Okumura
5,145,109 A * 9/1992 Faulstick ..... B65D 5/6626 206/395

(Continued)

*Primary Examiner* — Ghassem Alie
(74) *Attorney, Agent, or Firm* — Reinhart Boerner Van Deuren P.C.

(57) ABSTRACT

A blank forms a dispenser carton. The dispenser carton receives a rolled sheet to form a dispenser carton assembly. The dispenser carton has a top panel. A dispensing state of the dispenser carton the top panel includes a pair of locking tabs with notches received by a pair of flaps of side panels of the dispenser carton. The pair of flaps each have flap notches. The flap notches provide a gap between a top panel flange and a front panel of the dispenser carton. The pair of locking tabs are received into flap apertures of the pair of flaps. A pair of triangular gaps separate a portion of a back panel of the dispenser carton from left and right side panels to bias the pair of locking tabs against stops of the pair of flaps. A bottom panel of the dispenser carton includes a bottom aperture.

20 Claims, 6 Drawing Sheets

(56) References Cited

U.S. PATENT DOCUMENTS

| | | | | |
|---|---|---|---|---|
| 5,146,828 | A | 9/1992 | Huang et al. | |
| 5,207,367 | A | 5/1993 | Dunn et al. | |
| 5,226,571 | A * | 7/1993 | Eastwood | B65D 83/0882 225/49 |
| 5,423,464 | A | 6/1995 | Yuki et al. | |
| 5,768,968 | A | 6/1998 | Park et al. | |
| 6,105,481 | A | 8/2000 | Schuler | |
| 6,375,058 | B1 | 4/2002 | Passamoni | |
| 6,405,913 | B1 | 6/2002 | Passamoni | |
| 6,612,473 | B1 * | 9/2003 | Newby | B65D 83/0841 225/48 |
| 7,530,460 | B2 | 5/2009 | Lewis et al. | |
| 8,113,400 | B1 | 2/2012 | Santolalla | |
| 8,967,440 | B2 | 3/2015 | Chang | |
| 2005/0139626 | A1 * | 6/2005 | Owens | B65H 35/002 225/56 |

* cited by examiner

DISPENSER CARTON BLANK AND ASSEMBLY

FIELD OF THE INVENTION

This invention generally relates to dispenser cartons for food wraps, and more particularly to dispenser cartons for aluminum foil wraps, wax paper wraps, and parchment.

BACKGROUND OF THE INVENTION

Dispensers for food wraps, for example as disclosed in U.S. Pat. No. 3,933,288 to Struble are well known. The food wrap is typically a sheet that is rolled about a cardboard cylindrical tube. The rolled sheet is then placed in a dispenser carton. After purchase of the dispenser carton, the user opens the dispenser carton to gain access to a free end of the rolled sheet. The free end of the rolled sheet is grasped by a consumer to unwind the rolled sheet as the free end is pulled outside of the dispenser to obtain a desired length for use. Once the desired length of the sheet is reached it is cut to length, typically using a cutting edge or other means provided for by the dispenser. After cutting the rolled sheet along the cutting edge, the cut edge of the rolled sheet remains inside the dispenser and the top panel is closed over the top of the dispenser. When the user desires to dispense another portion of the rolled sheet the user must open the top panel and repeat the process just discussed.

Additionally, after cutting off a portion of the sheet for use and closing the top panel, the carton is stored for retrieval for future use. During the handling of the carton for storage and use, the rolled sheet typically moves within the carton and too easily falls out of the carton or causes the top panel to spring into a partially open position permitting the rolled sheet to at least partially move within the dispenser and thereby requiring the user to have to open the dispenser and readjust the rolled sheet in order to dispense a desired portion of the rolled sheet at the next use.

BRIEF SUMMARY OF THE INVENTION

In one aspect of the invention a blank for forming a dispenser carton that receives a rolled sheet to form a dispenser carton assembly is provided. The blank includes a front panel having a cutting edge. At an opposite edge the font panel is hingedly connected to a bottom panel. The front panel is also hingedly connected to a front left side flap and a front right side flap. The bottom panel is hingedly connected to a left side panel, and a right side panel. The bottom panel includes a bottom perforation surrounding a bottom area.

The right side panel has a right flap hingedly connected to the right side panel along a right flap fold line. The right flap has a right flap notch at a free right flap end and a right flap perforation extending at least a partial distance along the right flap fold line. The left side panel having a left flap hingedly connected to the left side panel along a left flap fold line. The left flap has a left flap notch at a free left flap end and a left flap perforation extending the partial distance along the left flap fold line.

A back panel is hingedly connected to the bottom panel, a back left side flap, and a back right side flap. The back left side flap and the back right side flap are hingedly connected to the back panel along a back left fold line and a back right fold line respectively. The back left side flap has a left perforation. The back right side flap has a right perforation. A top panel may be hingedly connected to the back panel, a left locking tab, and a right locking tab. A top flange is hingedly connected to the top panel.

In embodiments of this aspect of the invention the blank may have one or more, or combinations of, the following features:

The right flap perforation and the left flap perforation may extend along the right flap fold line and left flap fold line respectively.

The right flap perforation and the left flap perforation may each extend only a partial distance along the right flap fold line and the left flap fold line respectively.

The right flap perforation and the left flap perforation may be centered along the left flap fold line and the right flap fold line respectively.

The left flap notch may have a corner defined at an intersection of two sides of the left flap notch. The right flap notch may have a corner defined at an intersection of two sides of the left flap notch and two sides of the right flap notch respectively.

The bottom area surrounded by the bottom perforation may be one of a circular area, oval area, and rectangular area.

A side of the right locking tab and a side of the left locking tab each include a nonlinear portion in contact with the top panel.

The side of the right locking tab and the side of the left locking tab each include a second portion that extends obliquely relative to the left tab fold line and the right tab fold line respectively.

The left locking tab may include a left locking tab notch and the right locking tab may include a right locking tab notch.

The right locking tab notch and the left locking tab notch may each include a concave surface.

The left back perforation may extend a partial distance along the back left fold line. The right perforation may extend the partial distance along the right fold line.

The partial distance may be a length between 0.25 to 0.5 of the total distance measured from a third fold line hingedly connecting the top panel to the back panel to a second fold line hingedly connecting the back panel to the bottom panel.

A fourth fold line hingedly connects the top flange to the top panel. A central locking tab axis extends parallel to the third fold line. The central locking tab axis is nearer to the fourth fold line than to the third fold line.

A depression line connects terminal ends of the left perforation and the right perforation. The depression line extends parallel to the third fold line. The depression line is located between third fold line and the second fold line and may be nearer to the third fold line than to the second fold line.

In another aspect of the invention a dispenser carton assembly is provided. The dispenser carton of the dispenser carton assembly includes a front panel having a cutting edge and hinged connections to a front left side flap and a front right side flap. A bottom panel is hingedly connected to the front panel. The bottom panel has a bottom aperture.

A left side panel and a right side panel are each hingedly connected to the bottom panel. The left side panel is hingedly connected to a left flap. The right side panel is hingedly connected to a right flap. The left flap has a left flap aperture and a left flap notch. The right flap having a right flap aperture and a right flap notch.

A back panel is hingedly connected to the bottom panel, a back left side flap, and a back right side flap. The back left side flap is hingedly connected to the back panel along a back left fold line. The back right side flap is hingedly connected to the back panel along a back right fold line. A top panel is hingedly connected to the back panel. The top panel may be hingedly connected to a right locking tab and a left locking tab. A top flange is hingedly connected to the top panel. A rolled sheet has a central axis located within the dispenser carton.

In a dispensing state of the dispenser carton assembly, the top flange is inserted through the left and right flap notches. The right and left locking tabs are inserted into the left flap aperture and the right flap aperture respectively. A left triangular gap is defined by a partial separation between the left side panel the back panel. A right triangular gap is defined by a partial separation between the right side panel and the back panel. The right and left triangular gaps permit the biasing of the right and left notches towards a right flap stop and a left flap stop respectively.

In the dispensing state of the dispenser carton assembly, the rolled sheet may have a first portion located between a top surface of the top flange and an inside surface of the front panel.

In embodiments of this aspect of the invention the a dispenser carton assembly may have one or more, or combinations of, the following features:

The right locking tab may have a right notch. The left locking tab may have a left notch.

The right notch and the left notch may each have a convex surface facing the front panel and biased towards the front panel.

In dispensing state, one portion of the convex surface may be above the left flap and another portion may be below the left flap.

In the dispensing state, the user's finger or thumb inserted at least partially into the bottom aperture may unwind the rolled sheet to advance the first portion of the rolled sheet outside of the dispenser carton.

In the dispensing state, a total height of the back panel is defined between the top panel and the bottom panel. A left leg of the left triangular gap may extend along the back left fold line a partial length of the total height. A right leg of the right triangular gap may extend along the back right fold line a partial length along the total height. The partial length may be between 0.1 and 0.5 of the total height.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
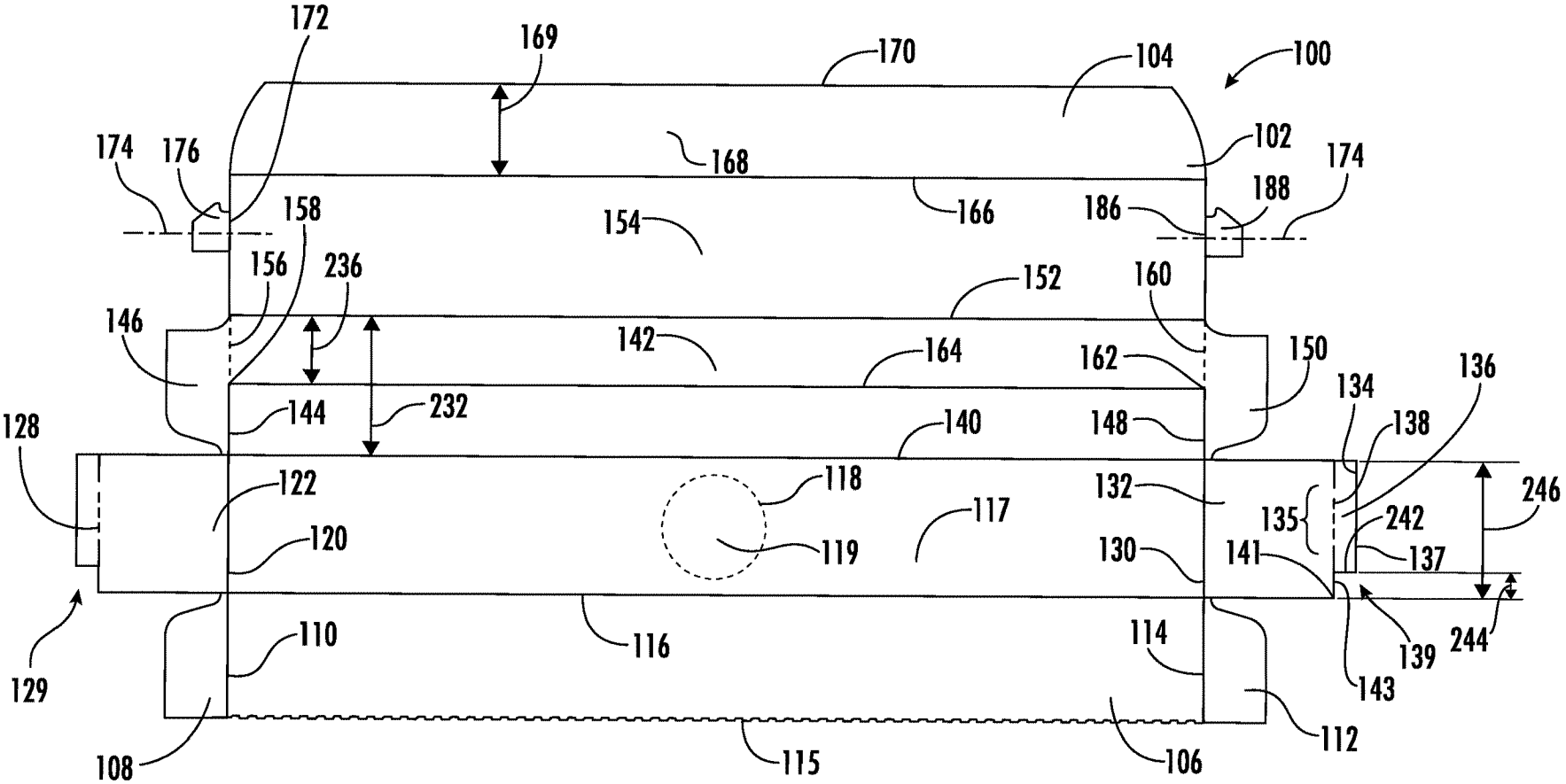
FIG. 1 illustrates the inner surfaces of an embodiment of an open blank for assembly into a dispenser carton according to the teachings of the instant invention.

Turning now to the drawings, there is illustrated in FIG. 1 an exemplary embodiment of a blank 100 for a dispenser carton 102. While such an exemplary embodiment will be utilized in describing various features and advantages of embodiments of the invention, such a description should be taken by way of example and not by limitation. Indeed, advantages of embodiments of the invention can be used to improve a variety of dispenser cartons and methods for their use.

The blank 100 for the dispenser carton 102 shows the surfaces 104 which form the inside of the dispenser carton 102 when assembled. Typically, the blank 100 is made of thick paper stock as in cardboard or like material. The dispenser carton 102 has a front panel 106 with a front left side flap 108 and a front left fold line 110. A fold line is understood as a providing a hinged connection via depression into the surface 104 to ensure a straight fold between desired areas of the blank 100. Thus, the front left fold line 110 provides the hinged connection of the font panel 106 to the front left side flap 108 such that the front left side flap 108 folds along the left fold line 110 towards the front panel 106 to assemble the blank 100. The front panel 106 also includes a front right side flap 112 and a front right fold line 114 hingedly connecting the front panel 106 and the front right side flap 112. A cutting edge 115 extends between the front left fold line 110 and the front right fold line 114. The cutting edge 115 may be formed into the blank 100 or alternatively may be fixed thereto via adhesive and like bonding means as is well known in the art.

A first fold line 116 hingedly connects the front panel 106 and a bottom panel 117. The bottom panel 117 includes a bottom perforation 118 that surrounds a bottom area 119 that may be removed before or after assembly of the dispenser carton 102 to create a bottom aperture.

The bottom area 119 may be circular or round, oval or rectangular or any shape that permits a user to at least partially insert a finger or thumb to wind or unwind a rolled sheet that is carried inside the dispenser carton 102 when assembled. Typically the bottom aperture is utilized to advance, that is unwind the rolled sheet to increase a portion of the rolled sheet outside the dispenser carton 102 so that it can be cut along the cutting edge 115 for use. Also, if there is too great a portion of the rolled sheet outside the dispenser carton 102, then the user may use the thumb or finger to wind the rolled sheet to decrease the portion outside the dispenser carton 102. The removal of the bottom area 119 may be done by a punch out, that is pressing the bottom perforation 118 to separate the perforations or by like means such as a utility knife.

In another embodiment, the blank 100 may include an aperture where the bottom area 119 is shown. The aperture may be covered using a temporary adhesive that permits a user to easily remove the cover before use. The cover may be a material such as a film or like thin covering that can withstand being handled but may also be easily removed by a user to uncover the bottom aperture. A left fold line 120 extending perpendicularly relative to the first fold line 116 hingedly connects the bottom panel 117 from a left side panel 122.

Figure 2:
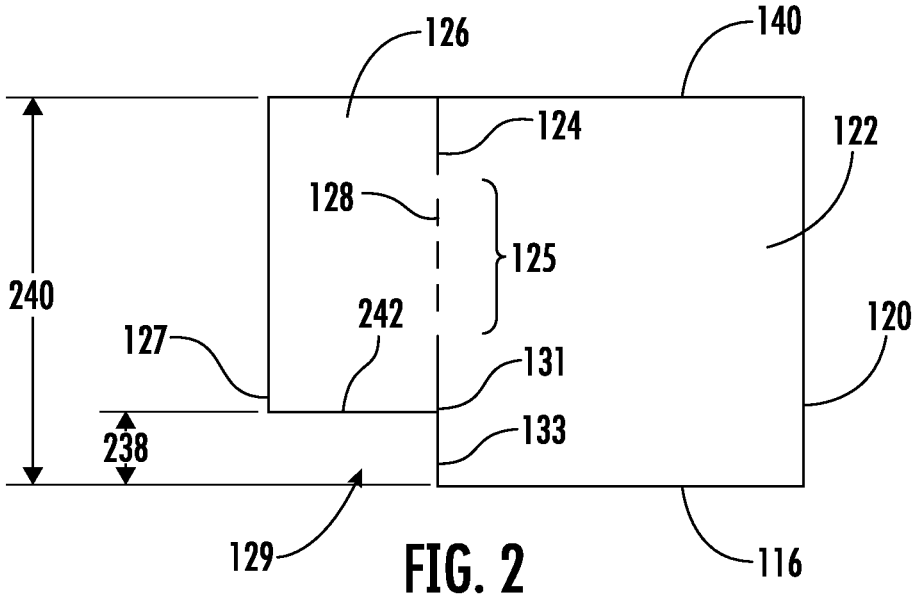
FIG. 2 is an enlarged view of the left side panel of FIG. 1.
Figure 9:
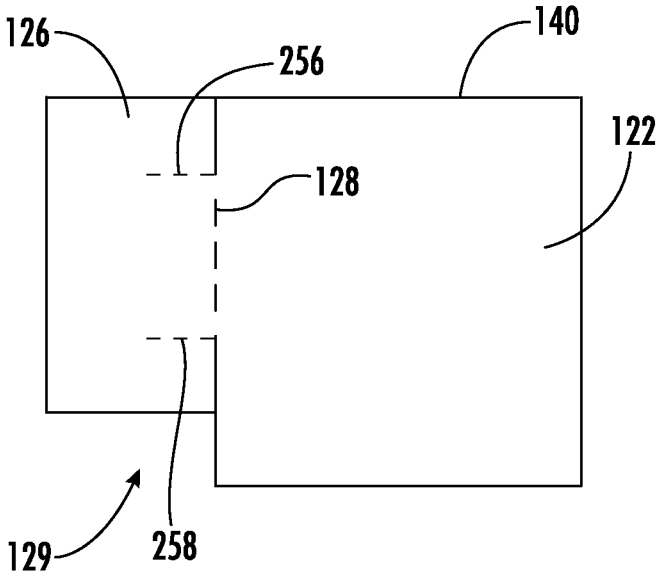
FIG. 9 is an enlarged view of another embodiment of the left locking tab.

Turning to FIG. 2, a left flap fold line 124 extending in a direction perpendicular to the first fold line 116 hingedly connects the left side panel 122 to a left flap 126. A left perforation 128 along a central portion 125 of the left flap line 124. The left perforation 128 permits a user to punch out, that is, press on the left perforation 128 during assembly of the dispenser carton 102 from the blank 100 (FIG. 1) so as to create an aperture by separating the perforations along the left perforation 128. While the left perforation 128 is shown as a line of perforations, in other embodiments as seen for example in FIG. 9 the left perforation 128 may include a first perforation 256 that is spaced apart from a second perforation to least partially surround an area 258. During assembly of the blank 100 (FIG. 1) or at purchase by a consumer a user may displace the perforations 128, 256, and 258 to create an aperture. For example, the area may be rectangular or oval or as seen in FIG. 9 "U" shaped. As seen in FIG. 9, the "U" shape would provide for a rectangular aperture.

The left flap 126 includes a left flap notch 129 formed into a free left flap end 127. The left flap notch 129 defines a left corner 131 of the left flap notch 129. The left corner 131 has a left side 133 extending parallel to the free left flap end 127 a partial width 238 that is between 0.1 and 0.4 of the total width 240 of the left side panel 122 extending between the first fold line 116 and a second fold line 140 and in a more preferred embodiment between 0.2 and 0.3. The left corner 131 has a second left side 242 that extends transverse to the left side 133 from the left flap fold line 124 to the free left flap end 127.

Returning now to FIG. 1, a right fold line 130 extending perpendicularly to the first fold line 116 hingedly connects the bottom panel 117 from a right side panel 132. A right flap line 134 extending in a direction perpendicular to the first fold line 116 hingedly connects the right side panel 132 to a right flap 136. A right perforation 138 extends along a central portion 135 of the right flap line 134. The right perforation 138 permits a user to easily press on the right perforation 138 once the blank 100 is assembled or during assembly so as to create an aperture by separating the perforations along the right perforation 138. As was discussed with respect to the left perforation 128 (FIG. 3) the right perforation 138 may have an embodiment as was described with respect to FIG. 9.

The right flap 136 includes a right flap notch 139 at a free right flap end 137. The right flap notch 139 defines a right corner 141 of the right flap notch 139. The right corner 141 includes a right side 143 extending parallel to the free right flap end 137 a partial width 244. The partial width 244 is between 0.1 and 0.4 of the total width 246 of the right side panel 132 and in a preferred embodiment between 0.2 and 0.3. The total width 246 of the right side panel is defined between the first fold line 116 and the second fold 140. The right corner 141 has a second right side 242 that extends transverse to the right side 143.

The second fold line 140 hingedly connects the bottom panel 117 to a back panel 142. A back left fold line 144 extending in a direction perpendicular to the second fold line 140 hingedly connects a back left side flap 146 to the back panel 142. A back right fold line 148 extending in a direction perpendicular to the second fold line 140 hingedly connects a back right side flap 150 to the back panel 142.

A third fold line 152 hingedly connects the back panel 142 to a top panel 154. The back left fold line 144 extends from the third fold line 152 to the second fold line 140 and defines a total height 232 of the back panel 142. The back right fold line 148 extends from the third fold line 152 to the second fold line 140 the total height 232. A left perforation 156 extends along the back left fold line 144 from the third fold line to a terminal left end 158 of the left perforation 156.

Thus, the total height 232 of the back panel 142 is defined between the third fold line 152 and the second fold line 140. The left perforation 156 also referred to as a left leg, extends along the back left fold line 144 a partial length 236 of the total height 232. In an embodiment, the partial length 236 of the left perforation 156 is 0.1 to 0.5 of the total height 232. In a preferred embodiment it is approximately 0.25 to 0.4, and in a more preferred embodiment between 0.2 and 0.3 of the total height 232. Thus, the left perforation 156 extends only a partial distance along the back left fold line 144. The left perforation 156 permits a user to easily separate the perforations of the left perforation 156 to form a slit using only their hands or small blade, such as a kitchen knife or utility knife by way of non-limiting examples.

A right perforation 160 extends the partial length 236 along the back right fold line 148 from the third fold line 152 to a right terminal end 162. Like the left perforation 156, the right perforation 160 permits a user to easily separate the perforations to form a slit using only their hands or small blade, such as a kitchen knife or utility knife by way of non-limiting examples.

A depression line 164 extends from the terminal left end 158 of the left perforation 156 to the terminal right end 162 of the right perforation 160. Thus, the depression line 164 is located between the second fold line 140 and the third fold line 152. The depression line 164 is approximately parallel to the second fold line 140 and the third fold line 152. By approximately parallel it is meant within five degrees of parallel.

A fourth fold line 166 hingedly connects a top flange 168 to the top panel 154. The fourth fold line 166 is approximately parallel to the third fold line 152. The top flange 168 has a total length 169 from the fourth fold line 166 to a free end 170 that is approximately between 0.2 and 0.7 the distance between the fourth fold line 166 and the third fold line 152, and in a preferred embodiment between 0.25 and 0.5 the distance.

Figure 3:
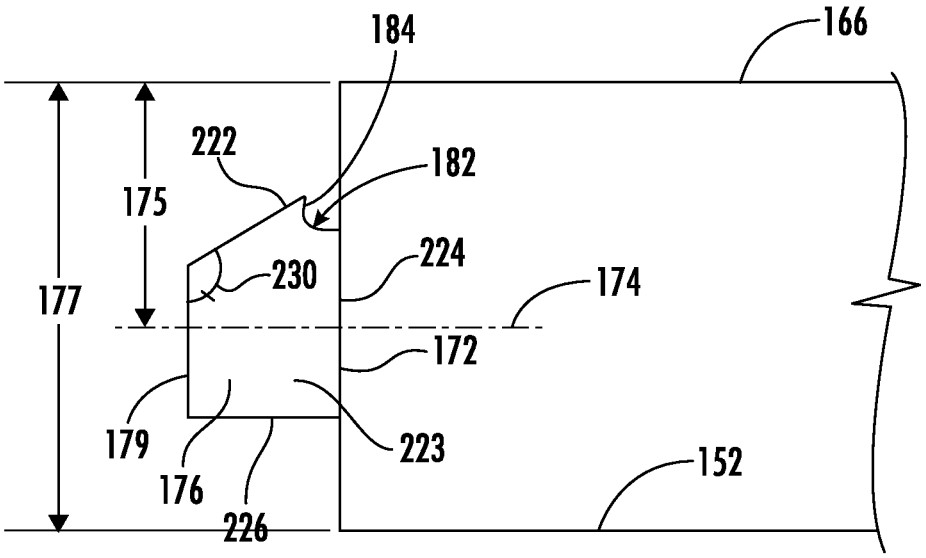
FIG. 3 is an enlarged view of the left locking tab of FIG. 1.

A left tab fold line 172 hingedly connects a left locking tab 176 to the top panel 154. The left tab fold line 172 extends in a direction perpendicular to the third fold line 152. Turning to FIG. 3, an enlarged illustration of the left locking tab 176 is shown. A central tab axis 174 extends in a direction parallel to the third fold line 152. The central tab axis 174 is located nearer to the fourth fold line 166 than to the third fold line 152. In an embodiment the central tab axis 174 is spaced away from the fourth fold line 166 towards the third fold line 152 a distance 175 that is approximately 0.1 to 0.6 the total distance 177 between the fourth fold line 166 and the third fold line 152 and in a preferred embodiment 0.25 to 0.5 the total distance 177. The total distance 177 is equal to the total width 246 of the bottom panel 117.

The left tab fold line 172 defines one side 224 of a left locking tab 176. The left locking tab 176 is generally a four sided tab with remaining sides 179, 222, and 226. In the embodiment shown, all of the sides are linear and in a parallel or perpendicular relationship to one another except for an oblique side 222 that extends obliquely, that is, it extends neither parallel to nor perpendicularly to toward the one side 224. The oblique side 222 extends towards the one side 224 that is along the left tab fold line 172 and has a left notch 182 formed in the oblique side 222 where it meets the one side 224 along the left tab fold line 172. In other embodiments, not illustrated, the remaining sides 179 and 226 need not be parallel or perpendicular to one another.

The oblique side 222 defines an interior (relative to the interior 223 of the locking tab 176) obtuse angle 230 as measured from the oblique side 222 to an insertion side 179. In an embodiment the left notch 182 may have a concave surface 184 but in other embodiments the interior surfaces of the left notch 182 may be planar surfaces. The insertion side 179 of the left locking tab 176 extends parallel to the one side 224 along the left tab fold line 172. The insertion side 179 is inserted into the left perforation 125 (FIG. 2) after its perforations have been separated during the assembly of the blank 100. The oblique side 222 advantageously acts as a bearing surface as the left locking tab 176 is inserted through the opening made in the left perforation 125 locking the top panel 154 and left flap 126.

Turning back to FIG. 1, a right tab fold line 186 hingedly connects a right locking tab 188 to the top panel 154. The right tab fold line 186 extends in a direction perpendicular to the third fold line 152. The central tab axis 174 extends in a direction parallel to the third fold line 152 through the right locking tab 188 and the left locking tab 176.

Figure 4:
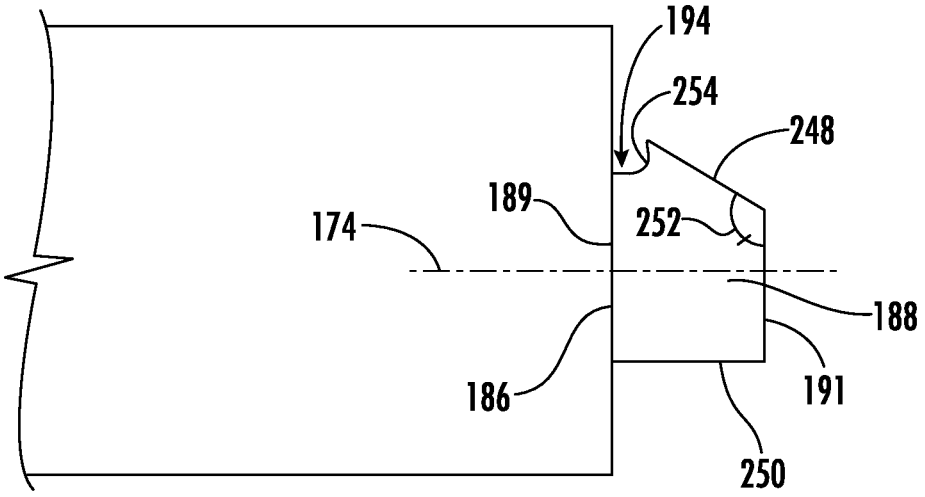
FIG. 4 is an enlarged view of the right locking tab of FIG. 1.

Turning now to FIG. 4, an enlarged view of the right locking tab 188 is shown. The right tab fold line 186 defines a side 189 of the right locking tab 188. The right locking tab 188 is structured to match size and shape of the left locking tab 176. Thus, the right locking tab 188 is generally a four sided tab with remaining sides 191, 248, and 250. The side 189 and the remaining sides 191 and 250 are linear and in a parallel or perpendicular relationship to one another. However, the remaining side 248 is an oblique side that is extends obliquely, that is, it extends neither parallel to nor perpendicularly towards the side 189. The oblique side 248 extends towards the side 189 that is along the right fold line 186 and has a right notch 194 formed in the oblique side 248 located between the oblique side 248 and the side 189 along the right tab fold line 186. In other embodiments, not illustrated, the remaining sides 191 and 250 need not be parallel or perpendicular to one another.

The oblique side 248 defines an interior obtuse angle 252 that is equal to the obtuse angle 230 (FIG. 3) of the right locking tab 176 (FIG. 3). In an embodiment, the right notch 194 may have a concave surface 254 but in other embodiments the interior surfaces of the right notch 194 may have planar surfaces. The remaining side 191 is an insertion end of the right locking tab 188 and extends parallel to the side 189 along the right tab fold line 186. The insertion side 191 is inserted into the right perforation 135 after its perforations have been separated during the assembly of the blank 100. The oblique side 248 advantageously acts as a bearing surface as the right locking tab 188 is inserted into the right perforation 135 locking the top panel 154 and the right flap 136.

Turning again to FIG. 1, the left locking tab 176 and the right locking tab 188 are shown as being integral with the blank 100 but in other embodiments the left locking tab 176 and the right locking tab 188 may be added to the blank 100 by bonding means such as glue and therefore need not be integrally formed with the blank 100.

In an embodiment, the left locking tab 176 and the right locking tab 188 may be perforated areas that may be "punched out" of top panel 154. In another embodiment they may not be part of the blank 100 but instead may be fastened to the blank 100 by means familiar to those in the art, such as adhesive, during or after assembly of the blank 100 into the dispenser carton 102.

In an embodiment, the left side panel 122, the front left side flap 108, and the back left side flap 146 may each have areas (not illustrated) that may be perforated such that when the dispenser carton 102 is assembled with a rolled sheet the areas line up with one another such that a user may press the perforated area towards the interior of the dispenser carton 102 and inside the hollow rolled tube of the rolled sheet such that the area pushed into the dispenser carton 102 remains connected to the dispenser carton and acts as a stop that cooperates with the left locking tab 176 and the right locking tab 188 to prevent the rolled sheet from falling out of the dispenser carton 102. The area also cooperates with the left locking tab 176 and the right locking tab 188 to minimize movement of the rolled sheet within the dispenser carton 102 thereby giving the user greater control of the desired amount of rolled sheet (not illustrated) to cut. The right side panel 132, the front right side flap 112, and the back right side flap 150 may also be perforated as just discussed to have an area that can be pushed into the right side of the hollow rolled tube for the same benefit as just discussed with respect to the left side panel 122.

Figure 5:
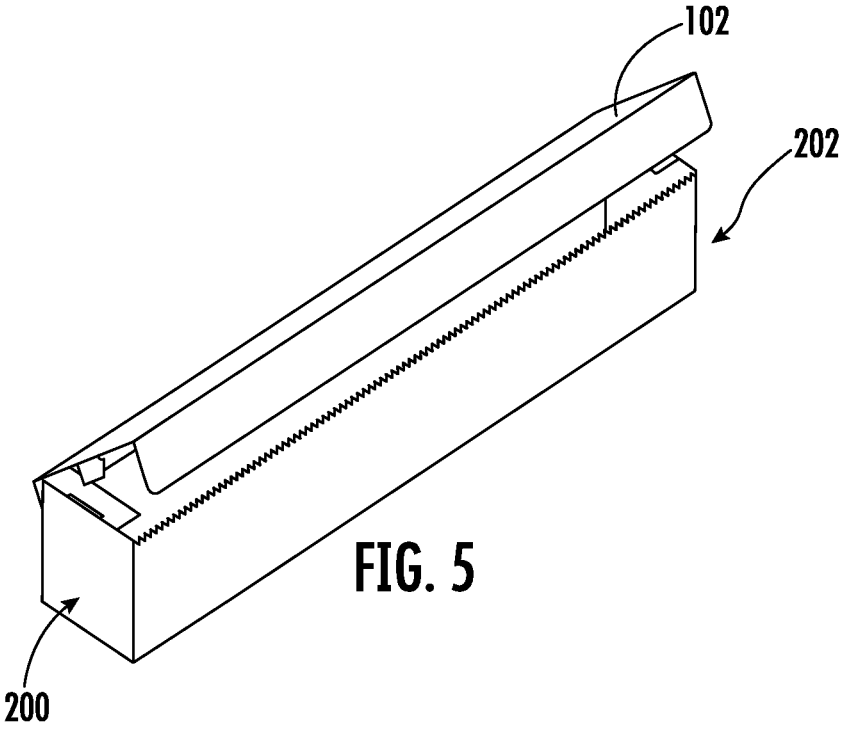
FIG. 5 is an isometric view of the dispenser carton in an open state as assembled from the blank of FIG. 1.

FIG. 5 illustrates the assembled dispenser carton 102 from the blank 100 (FIG. 1). The dispenser carton 102 is in its empty assembled state and with top panel 154 slightly opened so as to move the dispenser carton 102 into a dispensing state. The left side 200 of the dispenser carton will be discussed in greater detail below. However, the right side 202 of the dispenser carton opens and closes the same as the left side 200. It can now be readily appreciated with respect to the blank in FIG. 1, the left side 200 is symmetrical in all its structures and features with the right side 202. Therefore, the same features on the right side 202 will not be further discussed but are to be understood as being the same as those of the left side 200 which will be further described herein.

Figure 6:
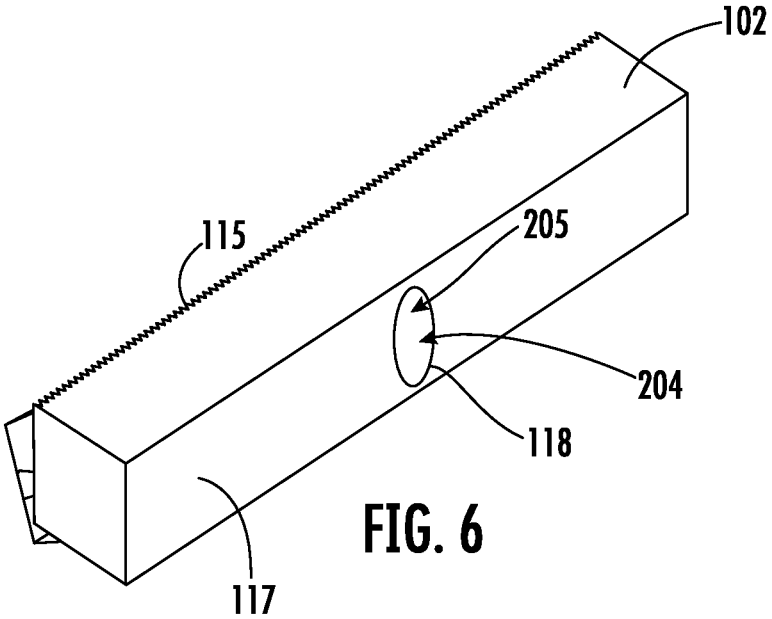
FIG. 6 is an isometric bottom and left side view of the assembled blank of FIG. 1 with a bottom portion removed to open a bottom aperture.

FIG. 6 illustrates the dispenser carton's 102 bottom panel 117 with the perforations of the bottom perforation 118 separated to remove the material outlined by the bottom perforation 118 and thereby open a bottom aperture 204 to provide access to a user to the interior 205 of the dispenser carton 102 with a thumb or a finger. Because of the location of the bottom aperture 204 a user is able to hold the dispenser carton 102 in a single hand and use a finger or thumb of the same hand holding he dispenser carton 102 to advance a rolled sheet located inside the dispenser carton 102. The user's other hand can then be used to grasp the rolled sheet that is outside the dispenser carton 102 and tear the desired size of the sheet from the remaining rolled sheet using the cutting edge 115.

Figure 7:
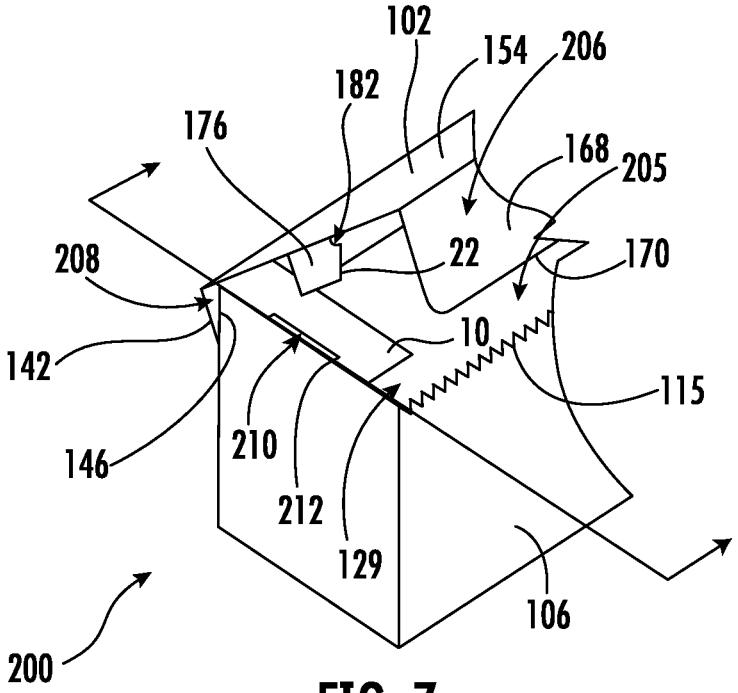
FIG. 7 is an enlarged view of the left side of FIG. 5.

Turning then to FIG. 7, an enlarged view of the left side 200 of FIG. 5 is shown. The top flange 168 is shown just before the free end 170 is inserted into the interior 204 of the dispenser carton 102. The top surface 206 of the top flange 168 will be biased towards the interior facing surface of the rolled sheet 214 (FIG. 8) but as will be further explained below, with negligible if any contact between the top surface 206 and the rolled sheet 214 (FIG. 8) such that the top surface 206 does not interfere with dispensing the rolled sheet 214 (FIG. 8).

Figure 8:
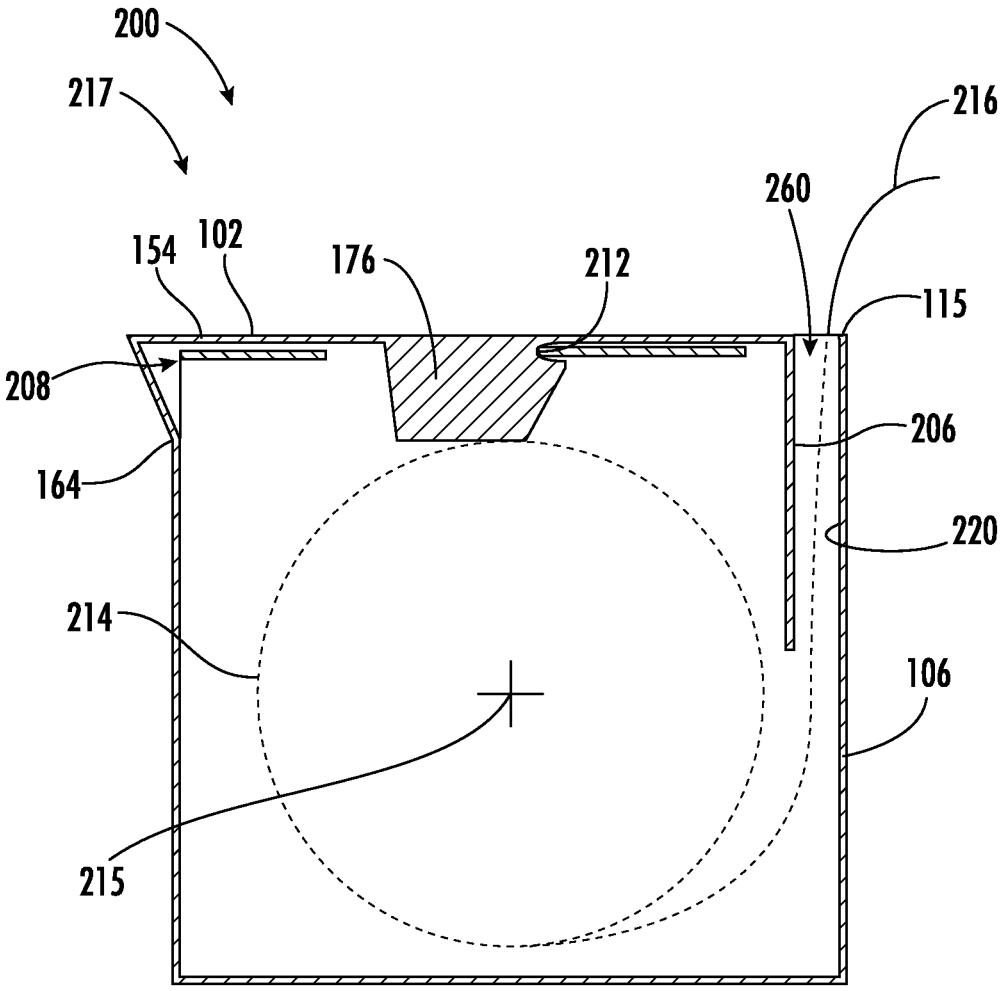
FIG. 8 is a vertical cross section of the left side of FIG. 8 but with a rolled sheet in the dispenser carton to illustrate a dispenser carton assembly with the dispenser carton in a dispensing state.

FIG. 7 illustrates the various features permitting the advantageous dispensing state as seen in FIG. 8. A clearance 260 (FIG. 8) between the top flange 168 and the front panel 106 is structurally made possible because of the space provided by the left flap notch 129 and the right flap notch 139 (FIG. 1). Such clearance between the top flange 168 and the front panel 106 permits the rolled sheet 214 (FIG. 8) to pass through the clearance 260 (FIG. 8) with the least amount of interference such that the rolled sheet 214 may easily pass through the clearance without becoming distorted.

The advantageous dispensing state is also made possible because the perforations of the left perforation 156 (FIG. 1) and the right perforation 160 (FIG. 1) have been separated to partially separate the back panel 142 from the back right side flap 146 such that a left triangular gap 208 and a right triangular gap (not illustrated) are created between the back panel 142 and the back left side flap 146 and the right back side flap 150 (FIG. 1) respectfully.

The advantageous dispensing state is also made possible because of the left locking tab 176 and the right locking tab 188 (FIG. 1) and their respective removably fixed insertions into the left tab aperture 210 and right tab aperture (not illustrated). The left tab aperture 210 and right tab aperture (not illustrated) are created when the perforations of the left flap perforation 128 (FIG. 1) and right flap perforation 138 (FIG. 1) are separated to remove or displace the material they surround and to thereby open the left flap tab aperture 210 and right tab aperture (not illustrated).

Still with respect to FIG. 7 the left notch 182 once inserted into the left flap tab aperture 210 is biased towards a left stop 212 of the left flap tab aperture 210 such that the top panel 154 must be move in a direction away from the cutting edge 115 to lift the top panel 154 and remove the left locking tab 176 (and the right locking tab) from the left flap tab aperture 210 and the right flap tab aperture (not illustrated). It is this biasing of the top panel 154 against the left stop 212 that prevents the biasing of the top surface 206 against the font panel 106 which would interfere with dispensing the rolled sheet 214. (FIG. 8) In the embodiment illustrated the inside surface of the left notch 182 is a concave surface that bears against the left stop 212. Once inserted into the aperture 210, left notch 182 has a portion of the convex surface above the left stop 212 and a portion below the left stop 212 as better seen in FIG. 8.

FIG. 8 illustrates a vertical cross section of the left end 200 of the dispenser carton 102 in its dispensing state with the rolled sheet 214 having a center axis 215 inside the dispenser carton 102. In the dispensing state, a free sheet end 216 of the rolled sheet 214 is outside the dispenser carton 102 such that a user can hold the free sheet end 216. Thus, the dispenser carton 102 with the rolled sheet 214 inserted therein may be referred to as a dispenser carton assembly 217 in a dispensing state. In the dispensing state the top surface 206 of the top flange 168 is inserted through the left flap notch 129 (FIG. 7) and is inside the dispenser carton 102.

In the dispensing state the left locking tab 176 is inserted in the left flap aperture 210 (FIG. 7) and is biased against the left stop 212. The biasing is made possible in part because of the left flap notch 129 (FIG. 7) that permits the top panel 154 to move laterally toward and away from the inside surface 220 of the front panel 106 and because of left triangular gap is 208 that is shown ending at the depression line 164.

The biasing of the left locking tab 176 towards and against the left stop 212 relieves the pressure/biasing force that would otherwise press the top flange 168 against the rolled sheet 214. Because this force has been removed or significantly lessened with the use of the left stop 212 (and right stop, not illustrate) the user is able to easily unwind and thereby advance the dispensing portion 218 of rolled sheet 214 to the desired length. That is, as previously discussed, a user may grasp the dispenser carton 102 in one hand, insert a thumb or finger into the bottom aperture 204 (FIG. 6) and advance the rolled sheet 214 while grasping near the free sheet end 216 to tear the desired dispensing portion 218.

Alternatively, the user may hold the dispenser container 102 in one hand without utilizing the bottom aperture 204 (FIG. 3) and pull on the free sheet end 216 and then tear the desired portion 218 using the cutting edge 115. In the dispensing state the dispenser carton 102 may be moved without the rolled sheet 214 lifting the top panel 154 and falling out of the dispenser carton 102. Advantageously, by providing the dispensing state discussed here, it can be readily appreciated that the user avoids the risk of cutting themselves along the cutting edge 115 while using their fingers to reach into the dispenser carton for the rolled sheet so as to pull it out of the dispenser carton 012. Instead, the user merely unwinds the roll via the aperture 204 (FIG. 6) without having to contact the cutting edge 115 trying to reach into the dispenser carton 102.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A blank for forming a dispenser carton for a rolled sheet, the blank comprising:

a front panel having a cutting edge and at an opposite edge, a hinged connection to a bottom panel, the front panel hingedly connected to a front left side flap and a front right side flap, the bottom panel hingedly connected to a left side panel and a right side panel, the bottom panel including a bottom perforation surrounding a bottom area;

the right side panel having a right flap hingedly connected to the right side panel along a right flap fold line;

the right flap having a right flap notch at a free right flap end and a right flap perforation extending a partial distance along the right flap fold line;

the left side panel having a left flap hingedly connected to the left side panel along a left flap fold line;

the left flap having a left flap notch at a free left flap end and a left flap perforation extending the partial distance along the left flap fold line;

a back panel connected to the bottom panel, a back left side flap, and a back right side flap, the back left side flap and the back right side flap connected to the back panel along a back left fold line and a back right fold line respectively, the back left side flap having a left perforation, the back right side flap having a right perforation;

a top panel hingedly connected to the back panel, a left locking tab, and a right locking tab;

a top flange hingedly connected to the top panel.

2. The blank of claim 1, wherein the right flap perforation and the left flap perforation extend along the right flap fold line and left flap fold line respectively.

3. The blank of claim 2, wherein the right flap perforation and the left flap perforation each extend only a partial distance along the right flap fold line and the left flap fold line respectively.

4. The blank of claim 2, wherein the right flap perforation and the left flap perforation are centered along the left flap fold line and the right flap fold line respectively.

5. The blank of claim 1, wherein the left flap notch and the right flap notch each have a corner defined at an intersection of two sides of the left flap notch and two sides of the right flap notch respectively.

6. The blank of claim 1, wherein the bottom area surrounded by the bottom perforation is one of a circular area, oval area, and rectangular area.

7. The blank of claim 1, wherein a side of the right locking tab and a side of the left locking tab each include a nonlinear portion in contact with the top panel.

8. The blank of claim 7, wherein the side of the right locking tab and the side of the left locking tab each include a second portion that extends obliquely relative to the left tab fold line and the right tab fold line respectively.

9. The blank of claim 1, wherein the left locking tab includes a left locking tab notch and the right locking tab includes a right locking tab notch.

10. The blank of claim 9, wherein the right locking tab notch and the left locking tab notch each include a concave surface.

11. The blank of claim 1, wherein the left back perforation extends a partial distance along the back left fold line and the right perforation extends the partial distance along the right fold line.

12. The blank of claim 11, wherein the partial distance is a length between 0.1 to 0.5 of the total distance measured from a third fold line hingedly connecting the top panel to the back panel to a second fold line hingedly connecting the back panel to the bottom panel.

13. The blank of claim 12, a fourth fold line hingedly connecting the top flange to the top panel, wherein a central locking tab axis extending parallel to the third fold line and the fourth fold line is nearer to the fourth fold line than to the third fold line.

14. A blank for forming a dispenser carton for a rolled sheet, the blank comprising:

a front panel having a cutting edge and at an opposite edge, a hinged connection to a bottom panel, the front panel hingedly connected to a front left side flap and a front right side flap, the bottom panel hingedly connected to a left side panel and a right side panel, the bottom panel including a bottom perforation surrounding a bottom area;

the right side panel having a right flap hingedly connected to the right side panel along a right flap fold line;

the right flap having a right flap notch at a free right flap end and a right flap perforation extending a partial distance along the right flap fold line;

the left side panel having a left flap hingedly connected to the left side panel along a left flap fold line;

the left flap having a left flap notch at a free left flap end and a left flap perforation extending the partial distance along the left flap fold line;

a back panel connected to the bottom panel, a back left side flap, and a back right side flap, the back left side flap and the back right side flap connected to the back panel along a back left fold line and a back right fold line respectively, the back left side flap having a left perforation, the back right side flap having a right perforation;

a top panel hingedly connected to the back panel, a left locking tab, and a right locking tab;

a top flange hingedly connected to the top panel;

wherein the left back perforation extends a partial distance along the back left fold line and the right perforation extends the partial distance along the right fold line;

wherein the partial distance is a length between 0.1 to 0.5 of the total distance measured from a third fold line hingedly connecting the top panel to the back panel to a second fold line hingedly connecting the back panel to the bottom panel;

wherein a depression line connects terminal ends of the left perforation and the right perforation, the depression line extending parallel to the to the third fold line, the depression line located between third fold line and the second fold line and nearer to the third fold line than the second fold line.

15. A dispenser carton assembly comprising:

a dispenser carton comprising:

a front panel having a cutting edge and hinged connections to a front left side flap and a front right side flap;

a bottom panel hingedly connected to the front panel, the bottom panel having a bottom aperture or a perforation for forming a bottom aperture, a left side panel and a right side panel each hingedly connected to the bottom panel, the left side panel hingedly connected to a left flap and the right side panel hingedly connected to a right flap, the left flap having a left flap aperture and a left flap notch, the right flap having a right flap aperture and a right flap notch;

a back panel hingedly connected to the bottom panel and a back left side flap and a back right side flap, the back left side flap hingedly connected to the back panel along a back left fold line and the back right side flap hingedly connected to the back panel along a back right fold line;

a top panel hingedly connected to the back panel, the top panel hingedly connected to a right locking tab and a left locking tab;

a top flange hingedly connected to the top panel;

a rolled sheet having a central axis located within the dispenser carton;

wherein in a dispensing state of the dispenser carton assembly the top flange is inserted through the left and right flap notches, the right and left locking tabs are inserted into the left flap aperture and the right flap aperture respectively, a left triangular gap is defined by a partial separation between the left side panel the back panel and a right triangular gap is defined by a partial separation between the right side panel and the back panel, the right and left triangular gaps permitting the biasing of the right and left notches towards a right flap stop and a left flap stop respectively, and wherein in the dispensing state of the dispenser carton assembly the rolled sheet has a first portion located between a top surface of the top flange and an inside surface of the front panel.

16. The dispenser carton assembly of claim 15, the right locking tab has a right notch and the left locking tab has a left notch.

17. The dispenser carton assembly of claim 16, wherein in the right notch and the left notch each have a convex surface facing the front panel and biased towards the front panel.

18. The dispensing carton of claim 17, wherein in the dispensing state, one portion of the convex surface is above the left flap and another portion is below the left flap.

19. The dispensing carton of claim 15, wherein in the dispensing state a user's finger or thumb inserted at least partially into the bottom aperture may unwind the rolled sheet to advance the first portion of the rolled sheet outside of the dispenser carton.

20. The dispensing carton of claim 15, wherein in the dispensing state, a total height of the back panel is defined between the top panel and the bottom panel, a left leg of the left triangular gap extends along the back left fold line a partial length of the total height, a right leg of the right triangular gap extends along the back right fold line a partial length along the total height, wherein the partial length is between 0.1 and 0.5 of the total height.

* * * * *